United States Patent [19]

Thompson

[11] Patent Number: 4,853,072

[45] Date of Patent: Aug. 1, 1989

[54] CORRUGATING MACHINES

[75] Inventor: Frederick H. Thompson, Marion, Ill.

[73] Assignee: Thompson Corrugated Systems, Inc., Marion, Ill.

[21] Appl. No.: 6,326

[22] Filed: Jan. 14, 1987

Related U.S. Application Data

[63] Continuation of Ser. No. 724,097, Apr. 17, 1985, abandoned.

[51] Int. Cl.[4] ..... B05C 11/00

[52] U.S. Cl. ..... 156/470; 118/258; 118/259; 118/261; 118/602; 156/210; 156/578

[58] Field of Search ..... 156/205–208, 156/210, 470–473, 578; 118/258, 261

[56] References Cited

U.S. PATENT DOCUMENTS

| | | | |
|---|---|---|---|
| 2,051,296 | 8/1936 | Goettsch | 156/473 |
| 2,051,319 | 8/1936 | Sieg | 156/472 X |
| 2,382,929 | 8/1945 | Williams | 118/212 |
| 2,827,873 | 3/1958 | Thorn | 156/470 X |
| 3,097,968 | 7/1963 | Schaefer | 118/259 |
| 3,300,359 | 1/1967 | Nikkel | 156/470 X |
| 3,511,693 | 5/1970 | Davidson | 118/602 X |
| 3,536,561 | 10/1970 | Griffiths | 156/205 |
| 3,695,221 | 10/1972 | Schaeuble | 118/261 X |
| 3,936,549 | 2/1976 | Kohler et al. | 118/259 X |
| 4,048,952 | 9/1977 | Peterson et al. | 118/261 X |
| 4,344,379 | 8/1982 | Roberts | 118/44 |
| 4,352,670 | 10/1982 | Georgiades | 118/602 X |

*Primary Examiner*—David Simmons

*Attorney, Agent, or Firm*—Haverstock, Garrett & Roberts

[57] ABSTRACT

A double-facer unit includes an applicator roller having a cylindrical outer surface with spaced depressions distributed relatively uniformly over the surface thereof, mechanisms for maintaining corrugation ridges opposite from the liner side of the single-face web against an arcuate portion of the outer surface of the applicator roller for applying adhesive thereto, and an adhesive container having adhesive therein exposed to the cylindrical surface of the applicator roller in the double-facer unit whereby the adhesive contained in the container is transferred to the surface of the applicator roller including into the depressions therein, a device associated with the adhesive container for scraping excess adhesive from the roller but not from the depressions whereby the adhesive remaining in the depressions is transferred to the corrugation ridges on the single-face web when in contact therewith, and mechanisms for maintaining predetermined tension on the single-face web during the time the adhesive in the depressions is in contact with the corrugation ridges, and a source of a second liner for attaching to the corrugation ridges on the single-face web.

15 Claims, 5 Drawing Sheets

78
24

18
22
84
82
24
70
74
68
66
28
86
65
67
20

122
120
56
60
118
124
126
134
128
58
50
48
102
106
30
104
100
108
114

110

CORRUGATING MACHINES

This is a continuation of application Ser. No. 724,097, filed on Apr. 17, 1985, now abandoned.

BACKGROUND OF THE INVENTION

The present invention relates generally to corrugating machines and, more particularly, to improvements in single-facer and double-facer units of the corrugating machines. The single-facer unit includes an adhesive applicator roller having an engraved surface that transfers or "prints" transverse parallel rows of adhesive onto a first liner, and means to contact said rows of adhesive with and bond said liner to the corrugation peaks of a corrugated medium to form a single-faced corrugated web; and the double-facer unit includes mechanism that maintain a single-face web in engagement for a predetermined interval with an adhesive applicator roller having a uniformly engraved surface which transfers or "prints" adhesive to the exposed corrugation peaks of the single-face web, and includes mechanisms to contact and bond the single-face web to a second liner to form a double-face corrugated web. The invention can also be used to form multi-ply corrugated structures, as well as to combine heat-sensitive, non-porous or highly graphic materials, the use of which was impractical under prior art methods.

DESCRIPTION OF RELATED ART

There exists an increasing need for a corrugating machine that produces corrugated board having smoother, more uniform external surfaces which allows detailed indicia to be imprinted thereon, having improved adhesive bonding characteristics and reduced propensity for dimensional instability, or warp, as well as possessing greater strength and improved stacking characteristics. Also, there is a need to improve the workplace environment around corrugating machines by virtually eliminating the necessity for heat and humidity in the corrugating process which is possible through the use of cold-set adhesives. Satisfying these needs are the principal goals of the present improvements.

Existing corrugating machines use steam-heated vessels plus live steam sprays to prepare the liners and mediums for corrugating and to cure the adhesive bonds between a liner and a corrugated medium. Typical of these machines are the corrugators described in U.S. Pat. Nos. 4,447,285; 4,056,417; 3,300,359; 2,572,716; and 2,384,676. The known operating single-facer units apply adhesive to the flute peaks of a corrugated medium, then contact a liner with and adhesively bond it to the corrugation peaks to form a single-face corrugated web. The prior art applications of adhesive to the flute peaks wipes a portion of some of the adhesive on the flanks of the corrugation flutes, allowing the liner to bond not only to the peaks but also to the flanks which when cured thereby causes "washboarding" or a ripple effect on the web surface. In addition, both an uneven application of a high moisture content adhesive and/or uneven temperatures induced onto the material will result in uneven moisture contents, which in turn lead to dimensional instability or warp of the finished product. This undesirable effect is further aggravated when hot set adhesives such as starches are applied and cured. Examples of such single-facer units are shown in U.S. Pat. Nos. 4,447,285; 4,056,417; 3,527,638; 3,518,142; and 2,572,716. Most single-facer units apply adhesive to the flute peaks while a plurality of elongated guide fingers maintain the corrugated web against a corrugating roller. On such a machine, the applicator roller has circumferential slots formed in its surface to accommodate the elongated guide fingers therein. The applicator roller in such constructions has adhesive removed from these slots, and this prevents bondings at these locations. When the liner bonds to the adhesive on the flute peaks, there are no bonds at the sites of the adhesive voids. Normally the weakest points, and the most common sites of collapse in corrugated products, are at the locations of these adhesive voids. An example of this type of single-facer unit is shown in U.S. Pat. No. 3,518,142. An alternative single-facer design also has guide fingers but applies the adhesive to a liner instead of to the peaks of a corrugated web. The adhesive on the liner then contacts and adhesively bonds to the peaks of a corrugated medium. This requires that the advancing speeds of the liner and the corrugated medium be accurately synchronized, and the synchronizing means for accomplishing this includes a relatively complex system of gears communicating the rotation of the corrugating rollers to the applicator roller of the single-facer unit. The volume of adhesive so transferred was dependent upon the clearances in a two-roll metering system and/or the nip pressure as a liner passed between an applicator roll and a pressure roll. Such procedures proved too cumbersome for practical manufacturing use and were not utilized in the industry. Such means are shown in U.S. Pat. Nos. 3,300,359 and 3,536,561.

In nearly all known double-facer units, adhesive is metered and applied by a three roller system to the exposed corrugation peaks of a single-face corrugated web. The single-face web in such devices passes between the applicator roller and a hold-down roller located above the applicator roller, which hold-down roller maintains the peaks of the single-face web in contact with the applicator roller while adhesive is applied thereto. The pressure applied by the hold-down roller on the single-face web often crushes or flattens the corrugations or corrugation peaks and thus weakens them and this results in the production of an inferior double-face corrugated web especially when the single-face web bonds to a second liner. Adhesive is metered onto the applicator roller by a doctor roll, which too operates with a gap from said applicator roller. Also, nearly all existing double-facer units "wipe" adhesive onto the flute tips as these flutes pass over the applicator roll at speeds in excess of the roller's own surface speed. Typical examples of such double-facer units are shown in U.S. Pat. Nos. 4,056,417 and 3,303,814.

Some double-facer units avoid flattening the flutes of the single-face web as adhesive is applied thereto by not using a hold-down roller. With no hold-down roller or other means to maintain the flutes of the single-face web engaged against the applicator roller surface, the web is allowed to "bounce" into and out of contact with the applicator roller. When the single-face web is allowed to bounce off the applicator roller, no adhesive will be applied to some of the peaks which pass over the applicator roller while the web is not in contact therewith and also may allow application of adhesive only partially across the length of other peaks. The absence of adhesive on some flute peaks and only a partial application of adhesive on other flute peaks prevents the second liner from bonding completely along the length of all of the flute peaks of the single-face web. The double-face corrugated webs produced in this manner are inferior and insufficient for most common uses of corrugated board. Such double-facer units are shown in U.S. Pat. Nos. 3,536,561 and 2,384,676.

High temperature and live, high pressure steam are also commonly used in double-facer units to improve the bonding conditions of the paper medium to the liner. Heat has also been used in conjunction with hot melt adhesives to bond the flute tips to the liners. Such double-facer units are described in U.S. Pat. Nos. 4,452,837; 4,056,417; and 2,384,676.

These features of the prior art have provided single-face and double-face corrugated webs having rippled external surfaces and inferior, weakened flutes and flute connections, have required substantial applications of heat and humidity which in turn creates an unacceptable workplace environment, and require both a substantial initial investment and extensive on-going maintenance. Excess heat also causes stretching and later contraction of the members which accentuates the undesirable ripple effect.

Although the constructions disclosed in the prior art have attempted to improve the surface smoothness and the strength and stackability of a corrugated board, all such constructions suffer from certain disadvantages and shortcomings. For example, heating units—often located within the corrugating machine's rollers—are required to prepare the liner for bonding to the corrugated medium when using common starch-based adhesives, and additional heating elements are needed for "setting" or curing these adhesive bonds. The temperatures of such heating units are commonly in the range of 350° to 375° Farenheit, with steam pressures approaching 200 PSI. Such high temperatures create difficulties in producing corrugated board, and also create an uncomfortable, unhealthy, and often dangerous workplace environment. The high temperature common in the two corrugating rollers and pressure roller of the existing single-facer units plus the unusual application of live, nign pressure steam onto the medium prior to its fluting, causes physical changes in the composition of the adhesive in the holding pan waiting to be used. This adhesive change often causes inadequate bonding and further adversely affects the smoothness of the resulting corrugated board's surface, and weakens the structural integrity of the corrugated board produced. One attempt that has been made to minimize the physical changes in the adhesive due to this heat includes placing a water-filled shield between the corrugating and pressure rollers and the adhesive container, but this complicates the structure of the corrugating machine and provides only minimal relief. The high temperatures or heat common in existing corrugating machines also tends to "dry out" the liner and the corrugated medium, which shrinks the liner and medium, further complicating the bonding process and is detrimental to the dimensional stability of the final product. Applications of heat to material after the latent moisture has been driven off will scorch or "cook" the individual fibers thereby causing further serious physical damage and deterioration of the final product.

Adhesive voids or "fingerlines" are another problem common in the single-facer units of existing corrugating machines. The voids exist when adhesive is applied to the peaks of a corrugated medium only between the guide fingers. Usually a plurality of such guide fingers that are shaped to conform to the second corrugating roller are located at spaced locations therealong to provide adequate support for the medium. The top ends of the guide fingers also extend into circumferential slots formed in the first corrugating roller to "strip" the corrugated medium from the first corrugating roller and maintain it engaged against the second corrugating roller while adhesive is applied to the corrugation peaks and until the medium reaches a nip formed by and between the second corrugating roller and the pressure roller. The surfaces of adhesive applicator rollers used in such corrugating machines also have circumferential slots for receiving the guide fingers therein, such that when adhesive is applied to the peaks of the corrugated medium there exist voids in the adhesive corresponding to the locations of the slots in the applicator roller. In operation, these voids tend to increase in size because debris and jellied adhesive accumulate on the guide fingers and because of wear on the applicator roller adjacent to the slots. The lack of adhesive in these locations causes bonding voids which are normally the weakest points in the stacking strength of the finished product and are the most common sites of collapse in corrugated board. Some corrugating machines eliminate the need for guide fingers and rely on either air pressure or vacuum systems to retain the medium against the second corrugating roller thereby enabling the application of a relatively uniform amount of adhesive along the corrugation peaks. However, such systems normally have operating adjustment difficulties that allow the medium to either "flutter" away from the second corrugating roller or to be forced into said vacuum slots themselves, both of which tend to deform the flutes and weakens their structural integrity. These vacuum and/or pressure systems are also substantially more expensive to install and maintain than are guide finger systems.

Another attempt to eliminate adhesive voids involves applying adhesive to the liner and then registering the adhesive on the liner with and bonding it to the peaks of the corrugated medium. This is achieved by synchronizing the rotation of the corrugating rollers with the rotation of the applicator roller through a system of gears. Adhesive is "squeezed" onto the liner in rows that are spaced apart the same distance as the distance between adjacent flute peaks of the corrugated medium. Because the advancing speeds of the liner and the corrugated medium are the same, the adhesive rows on the liner register with the peaks of the corrugated medium as the liner and the corrugated medium pass through the nip between the second corrugating roller and the pressure roller. Although this prior art construction prevents adhesive voids and retains the guide fingers, the addition of the synchronizing gears it employs greatly complicates the mechanical operation of the corrugating machine.

An additional problem caused in both the single-facer and double-facer units when adhesive is wiped onto the corrugation peaks is that some adhesive builds up on the flanks of the corrugations and tends to pull the liner around the corrugations as the adhesive cures and bonds the liner to the corrugations' flanks. This causes a "washboard" or ripple effect on the corrugated board's surface, and shrinkage in the paper or other material from latent moisture loss at high operating temperatures accentuates this problem. This ripple effect reduces the attractiveness of the corrugated board and limits the ability to print attractively and accurately thereon. This in turn reduces the aesthetic and marketing qualities of the resultant corrugated board.

In the known double-facer units another significant problem is weakened corrugations—and therefore weakened corrugated board—which corrugations of the single-face web are damaged during the application of adhesive thereto in the double-facer unit. In most known double-facer units, a hold-down roller is provided to maintain the single-face web tangentially against the adhesive applicator roller which is coated with a continuous film of adhesive. The pressure exerted by the hold-down roller on the single-face web crushes or flattens the corrugations as the peaks contact the adhesive applicator roller. Crushed corrugations substantially decrease the stacking and flat crush strength of the resulting corrugated product, and decreases the bonding capability of the corrugations.

SUMMARY OF THE INVENTION

The present improvements to corrugating machines overcome many of the shortcomings and disadvantages associated with known corrugating machines and teach the construction and operation of relatively simple, efficient and economical single-facer and double-facer units of corrugating machines. For example, the present single-facer and double-facer units have means to "wrap" the liner (in the single-facer) and the single-face web (in the double-facer) against and over the respective applicator rollers, allowing the applicator rollers to transfer precise volumes of adhesive from depressions in the rollers' surfaces onto the respective liner and medium. This permits the use of cold-set as distinguished from hot-set adhesives. Cold-set adhesives require little, if any, heat to cure and to bond and this is an important advantage both from the standpoint of the complexity of the machinery involved and also from the standpoint of the quality of the resulting product. Eliminating heat in the production of corrugated board, for example, produces more uniformly smooth product surfaces caused by the improved bonding characteristics of the adhesive, eliminates most causes of warp and ripple in the final product, substantially improves the workplace environment by lowering the temperature and humidity therein, substantially reduces the initial capital investment, maintenance and operating costs of a corrugator, and enables the production of a moisture resistant bond far superior to that of heat-set starches. The elimination of heat also permits temperature sensitive and/or less porous materials to be combined on a corrugator when such was heretofore impractical or impossible to achieve. However, the improvements described herein can also be incorporated into a corrugating machine that retains heat-set adhesives, and even in such will improve the operation.

Also, the roller configuration in the present single-facer unit permits guide means, including prior art guide fingers, to be located adjacent to the second corrugating roller. The guide fingers are inexpensive and practical devices which have been proven to prevent the corrugated medium from "fluttering" or moving out of engagement with the second corrugating roller thus maintaining the structural integrity of the flutes particularly when used in conjunction with one of the several available means of "cushioning" them with either air bladders or spring mechanisms. In the present roller configuration, the applicator roller is located away from the guide fingers and applies adhesive to the liner rather than to the corrugated medium or member, which eliminates the adhesive voids or "fingerlines" common in corrugated board produced by most known corrugating machines. The present single-facer applicator roller also applies precisely the amount of adhesive contained in each cell in transverse parallel rows to the liner through the cohesive properties of the adhesive itself, and these rows are brought into contact along the entire length of the corrugation peaks to allow a continuous bond to form thereacross. The precise metering techniques of doctor blade systems and various methods and patterns for installing finite cells on roller surfaces are known art.

The surface speeds of the applicator rollers in the present single-facer and double-facer units are matched precisely to the advancing speeds of the respective mediums which is especially important. The rotational speed of the applicator roller surface can be controlled, such as by means of an electronically paced variable speed drive motor, so that the surface speed is equal to the advancing speed of the fluted medium. Various means for controlling the rotational speed of the applicator roller can be utilized The present single-facer and double-facer designs allow only the corrugation peaks to contact a precise volume of adhesive and thereby prevents adhesive from building up on the flanks of the corrugations. Since the liner then bonds only to the peaks of the corrugated medium the resultant corrugated board has virtually smooth liner surfaces. The present single-facer and double-facer adhesive applicator systems further reduce unneeded adhesive by using wiper blade assemblies to meter the adhesive picked up by the applicator rollers. Although using a wiper blade to meter adhesive on an applicator roller is known in the art, this feature is important to the present improvements because the wiper blade precisely removes adhesive from the roller surface without disturbing the adhesive contained within depressions formed in the roller surface. The wiper blade therefore allows accurate control of the adhesive volume that is applied to the respective surfaces of the liner or medium. This also reduces the amount of adhesive that is needed to form a corrugated product, thereby resulting in considerable cost savings. Because of this consistent volume control, only the precise amount of adhesive contained in each cell is used. Matching the cell capacity with the bonding characteristics of the specific adhesives and corrugation liners and mediums will therefore stabilize the adhesive application rates which in turn facilitates the use of cold-set adhesives or minute volumes of high-solids starch formulations. It is contemplated that the expanded capability to bond a wider range of materials on a corrugator will lead to the need for easily interchanging the applicator rollers and adhesives to match the particular production schedules. The simplified design, placement of the applicator rollers, and low volumes of adhesives all support this desire.

The present double-facer unit as disclosed in one embodiment also includes one or more idler rollers positioned parallel with the applicator roller, which idler roller or rollers wraps a predetermined portion of the single-faced web against and around a portion of the applicator roller surface thereby allowing adhesive to be transferred from the depressions in the roller surface onto the exposed flute peaks of the single-face web. The use of either one or two idler rollers will be determined by the specific web elevation at the adhesive application unit's entry and exit positions. The idler rollers are used to maintain a circumferential wrap around a portion of the adhesive applicator roller, as distinguished from tangential contact only, thereby allowing sufficient contact time between the flute tips and the adhesive during the time the adhesive within the cells migrates to the flute tips and allows the adhesive to be "picked" out of the individual cells and deposited precisely upon the flute tips. The idler rollers therefore provide for wrap-around and not a width gap, and since the tension on the web is minimal, and the speed of the advancing single-face web is precisely matched to the surface speed of the adhesive roller and no flute crush occurs. It is also salient to note the corrugating process utilizes various thicknesses of materials. Prior art double-facer adhesive applicators required the web to pass through a single nip of two rollers, the clearance of which was critical and required considerable adjustment and maintenance effort. The present double-facer adhesive applicator eliminates both of the prior art nip points and all of the operational and mechanical difficulties inherent therein. This idler roller web wrap system therefore acts to maintain the flute profiles and therefore improves the strength and consistency of the resulting corrugated product. Adjustment of the idler rollers can be permitted to allow a wide range of web wrapping arcs which would be desirable for operating flexibility and to match the characteristics of various adhesive formulations and the cohesive properties therein. The tension on the web produces the force of the web against idler rollers and the applicator rollers and can be automatically or manually adjusted by suitable means including means associated with the vacuum suction means, and when properly adjusted substantially reduces the possibility that the corrugation peaks of the single-face web will be crushed or flattened as they move against and are maintained against the applicator roller.

The single-facer and double-facer units disclosed herein may also be assembled in an existing corrugating machine that has provision for accommodating one or a plurality of single-facer units and an appropriate number of double-facer adhesive units for the production of multi-ply corrugated board.

A principal object of the present invention is to provide means to produce improved single-face, double-face and multi-ply corrugated boards.

Another object is to teach the construction and operation of machinery to produce corrugated board having greater strength and improved stacking characteristics as compared to prior constructions.

Another object is to produce corrugated board having improved surface smoothness characteristics and therefore improved printability characteristics.

Another object is to provide relatively simple, easy to construct and easy to operate means for producing corrugated structures.

Another object is to use a cold-set as distinguished from a hot-set adhesive in the construction of corrugated members.

Another object is to provide a corrugating machine which reduces or eliminates the need for heat during production of single-face, double-face and multi-ply corrugated boards.

Another object is to reduce the amount of adhesive needed to produce corrugated paperboard products.

Another object is to provide a single-facer unit having a cleaner, more efficient adhesive applicator system.

Another object is to improve the bond between the liner and the corrugated medium in the single-facer unit by registering rows of adhesive spots on the liner with the flute peaks of the corrugated medium to be attached thereto.

Another object is to register the adhesive rows of dots on a liner with the corrugation peaks of the corrugated medium by synchronizing the advancing speed of the liner to the advancing speed of the corrugated medium in a single-facer unit.

Another object is to retain the guide means including a plurality of guide fingers in a single-facer unit while applying adhesive in rows of adhesive spots onto the liner to permit the liner to bond to the corrugated medium uniformly all the way across the medium.

Another object is to eliminate adhesive voids between the liner and the corrugated medium in a corrugated structure to prevent the formation of adhesive voids or "fingerlines" in the production of a single-face corrugated web.

Another object is to provide improved means in a double-facer unit to controllably position and maintain the peaks of the single-face web against an adhesive applicator roller.

Another object is to prevent crushing or flattening of the corrugations of the single-face web while applying adhesive to the corrugation peaks thereof.

Another object is to provide efficient means in a double-facer unit for transferring adhesive to the exposed peaks of the single-face web.

Another object is to correlate the rotational speed of a double-facer applicator roller surface with the advancing speed of a single-face web to permit more precise transfer of adhesive to the corrugation peaks of the web.

Another object is to provide improved means to produce multi-ply corrugated board.

Another object is to permit the use of heat sensitive and/or non-porous materials for liners and/or mediums.

Another object is to enable the practical use of synthetic adhesives which inherently are more consistent than starches, dextrins or other modified natural adhesives, and which can be formulated to produce improved bonding characteristics over a wider range of materials.

These and other objects and advantages of the present invention will become apparent to those skilled in the art after considering the following detailed specification which discloses several different embodiments of the present improvements in conjunction with the accompanying drawings, wherein:

DESCRIPTION OF THE PREFERRED EMBODIMENTS

Figure 1A:
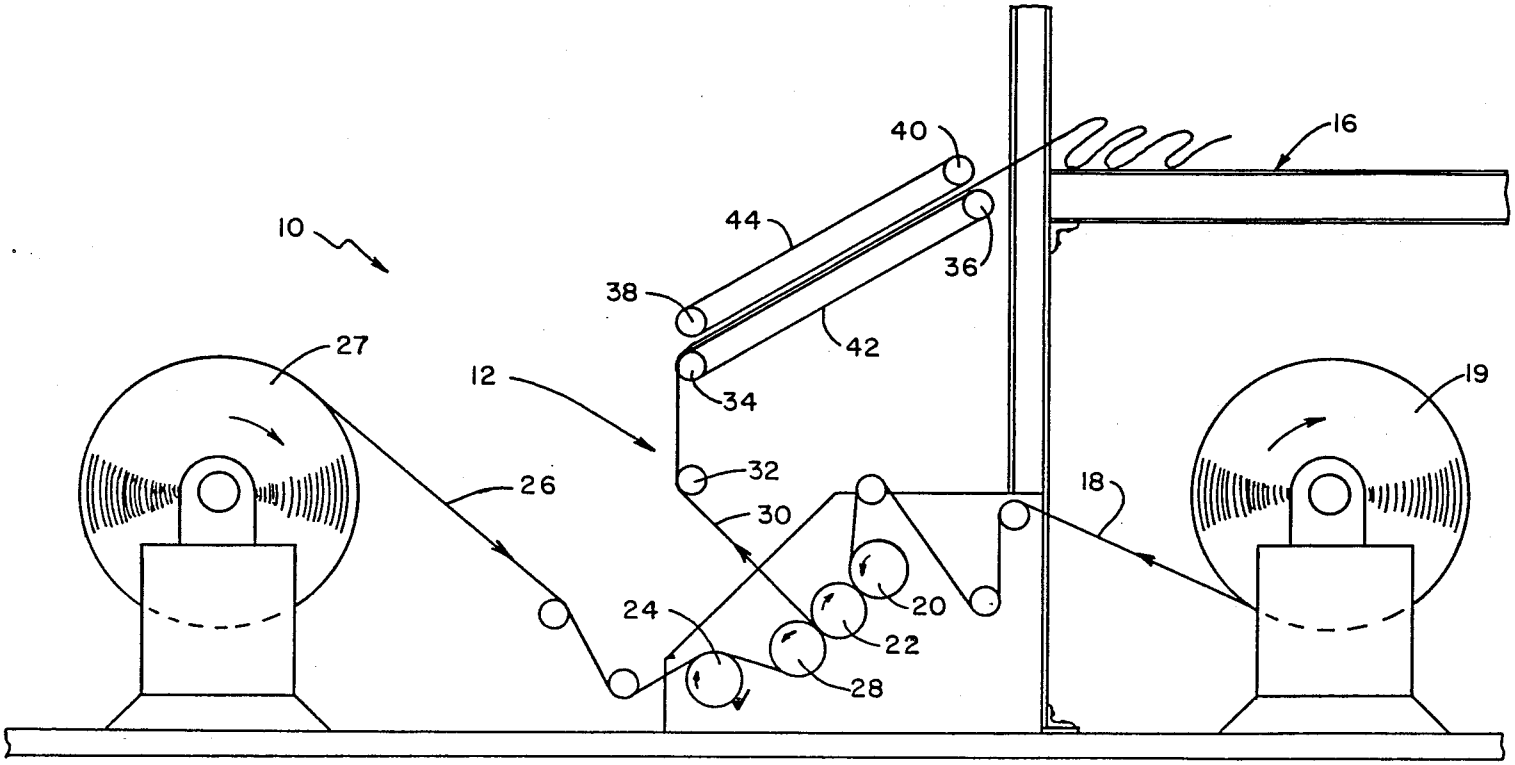
FIG. 1A is a side elevational view of a single-facer unit of a corrugating machine including the present improvements.
Figure 1B:
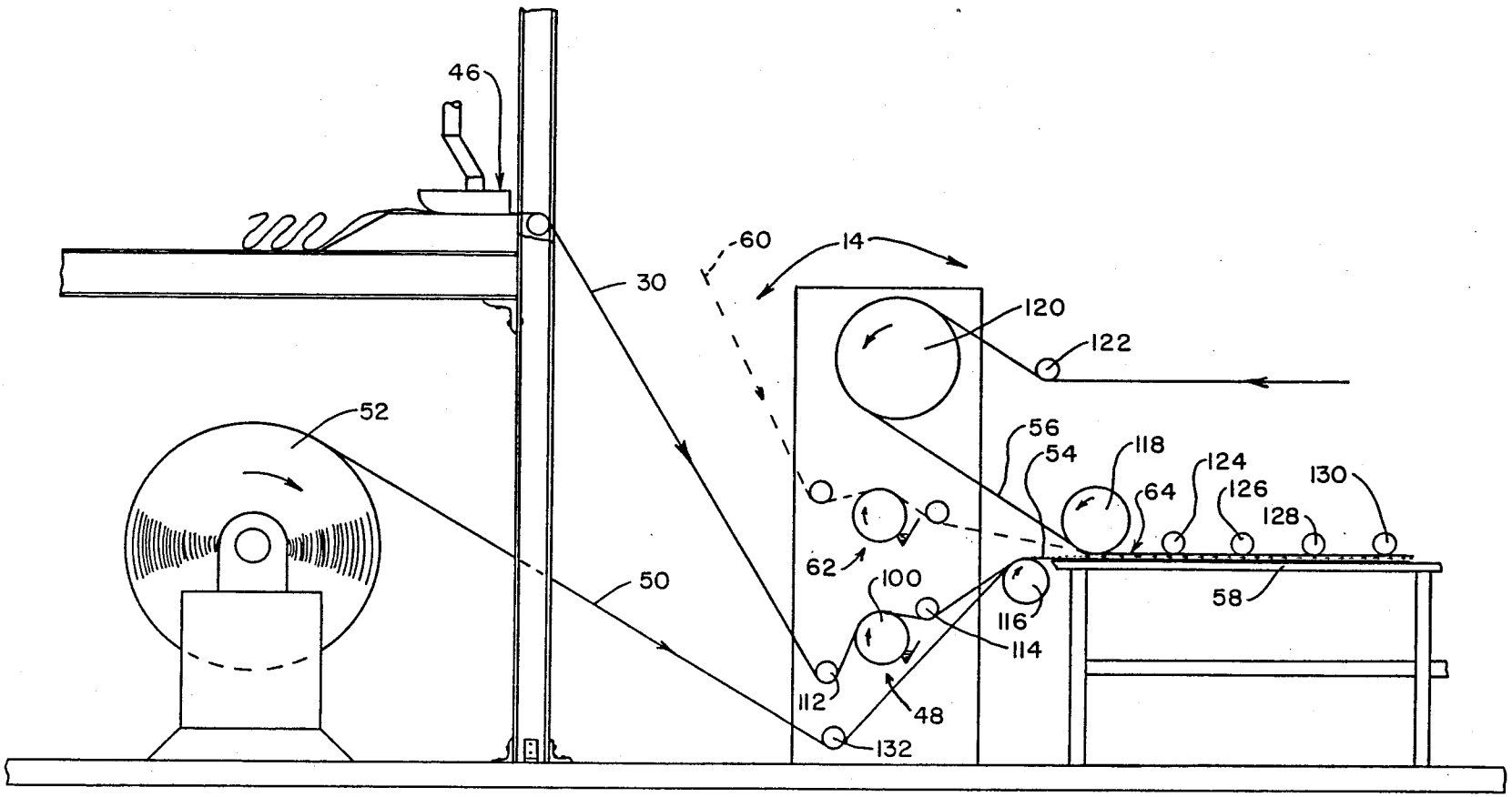
FIG. 1B is a side elevational view of a double-facer unit of the same corrugating machine including many of the present improvements.

Referring to the drawings more particularly by reference numbers wherein like numerals refer to like parts, number 10 in FIG. 1A refers to the entire assembly shown in FIGS. 1A and 1B which together constitute a machine for producing corrugated board constructed according to the teachings of the present invention. The corrugating machine 10 comprises at least one single-facer unit 12 (shown in FIG. 1A) and double-facer unit 14 (shown in FIG. 1B) with at least one adhesive application unit. The single-facer unit 12 is connected by one or more bridges or single-face accumulation means such as bridge 16 which receives the output of the single-facer unit 12 and accumulates it for feeding to the double-facer unit 14. In the single-facer unit 12 (FIG. 1A), a medium 18 from supply roll 19 is corrugated by passing it between cooperatively engaged first and second corrugating rollers 20 and 22. An adhesive applicator roller 24 is employed in the unit 12 and applies adhesive to a first liner member 26 to be attached to the corrugated medium 18. The liner 26 which is fed from a separate source roll 27 picks up adhesive from the roller 24 and thereafter moves around and through a nip to be described later formed by and between a pressure roller 28 and the second corrugating roller 22. In so doing, the liner 26 will contact and be adhesively bonded to the flutes on one side of the corrugated member or medium 18 as will be more fully explained, thereby producing a single-face web 30.

The single-face web 30 is guided by means including guide rollers 32, 34, 36, 38, and 40 and associated means shown as belts 42 and 44 constructed as shown onto an accumulation device such as onto the bridge 16 where it accumulates in an accordian-like manner and is drawn therefrom adjacent the opposite end of the bridge 16 to be fed over a series of other spaced rollers to be described into the double-facer unit 14 (FIG. 1B). The bridge 16 and the support rollers in the double-facer unit onto which the single-face web 30 is drawn should include controlled drag producing means such as controlled suction means 46 which engage the single-face web 30 on the liner side and operate to maintain controlled tension thereon as it is fed to the double-facer unit 14. In the double-facer unit 14, adhesive is applied to the flute peaks of the single-face web 30 on the opposite side of the corrugated medium 18 from the side attached to the liner 26 in the single-facer unit 12 while the web 30 is passing through an adhesive applicator unit 48. Also, in the double-facer unit 14 a second liner member 50 from source roll 52 is brought into contact with and bonds to the flute peaks that have adhesive applied to them to complete the construction of double-face corrugated web 54. The completed web 54 then passes between means such as endless belt 56 and a support member 58 which hold the members together for a long enough time for the adhesive, which is preferably a cold-set adhesive, to form a bond. A heated curing unit, not shown, can optionally also be used if a heat-induced bonding adhesive is utilized although this is not normally preferred. The liner 26, the corrugated medium 18 prior to being corrugated, and the liner 50 are drawn from their respective supply rolls 27, 19 and 52 which are replaced periodically by fresh rolls, as required.

Additional similarly constructed single-facer units (not shown) may optionally be provided and utilized within the same overall corrugating machine 10 to simultaneously produce additional single-face webs such as web 60 (FIG. 1B). The web 60 is accumulated on another bridge structure similar to the bridge 16, not shown, (FIG. 1B) for feeding through another adhesive applicator unit 62. In the unit 62 the corrugation peaks of the single-face web 60 have adhesive applied thereto in the same manner as for the web 30. Thereafter the web 60 can be bonded to the liner 26 on one side of the corrugated web 54 to produce a double-ply corrugated panel or board 64. These bonds can also be cured by being held together and/or they can be cured with the help of a special curing unit. Additional single-face webs can be constructed and applied in a similar manner to increase the number of plies in a given corrugated structure as desired.

Figures 2, 5, 6, 7:
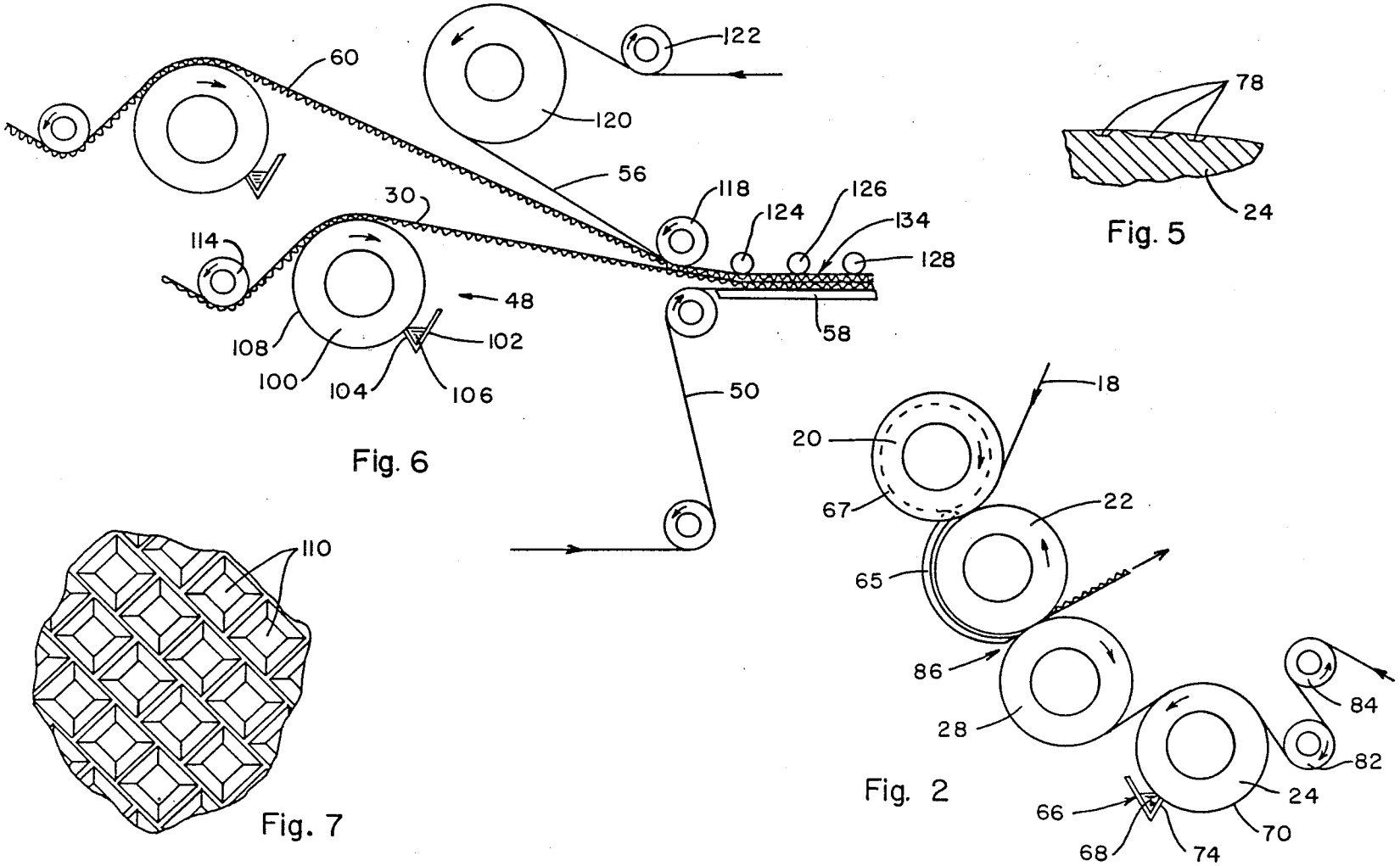
FIG. 2 is an enlarged side elevational view of the roller structure employed in the single-facer unit of the machine of FIG. 1A.
FIG. 5 is an enlarged fragmentary cross-sectional view of several of the applicator roller depressions of FIG. 4, said view being taken along the line 5—5 therein.
FIG. 6 is a side elevational view showing a portion of the roller structure employed in the double-facer unit of FIG. 1B.
FIG. 7 is an enlarged fragmentary view showing a portion of the surface of an applicator roller employed in the double-facer unit.
Figure 3:
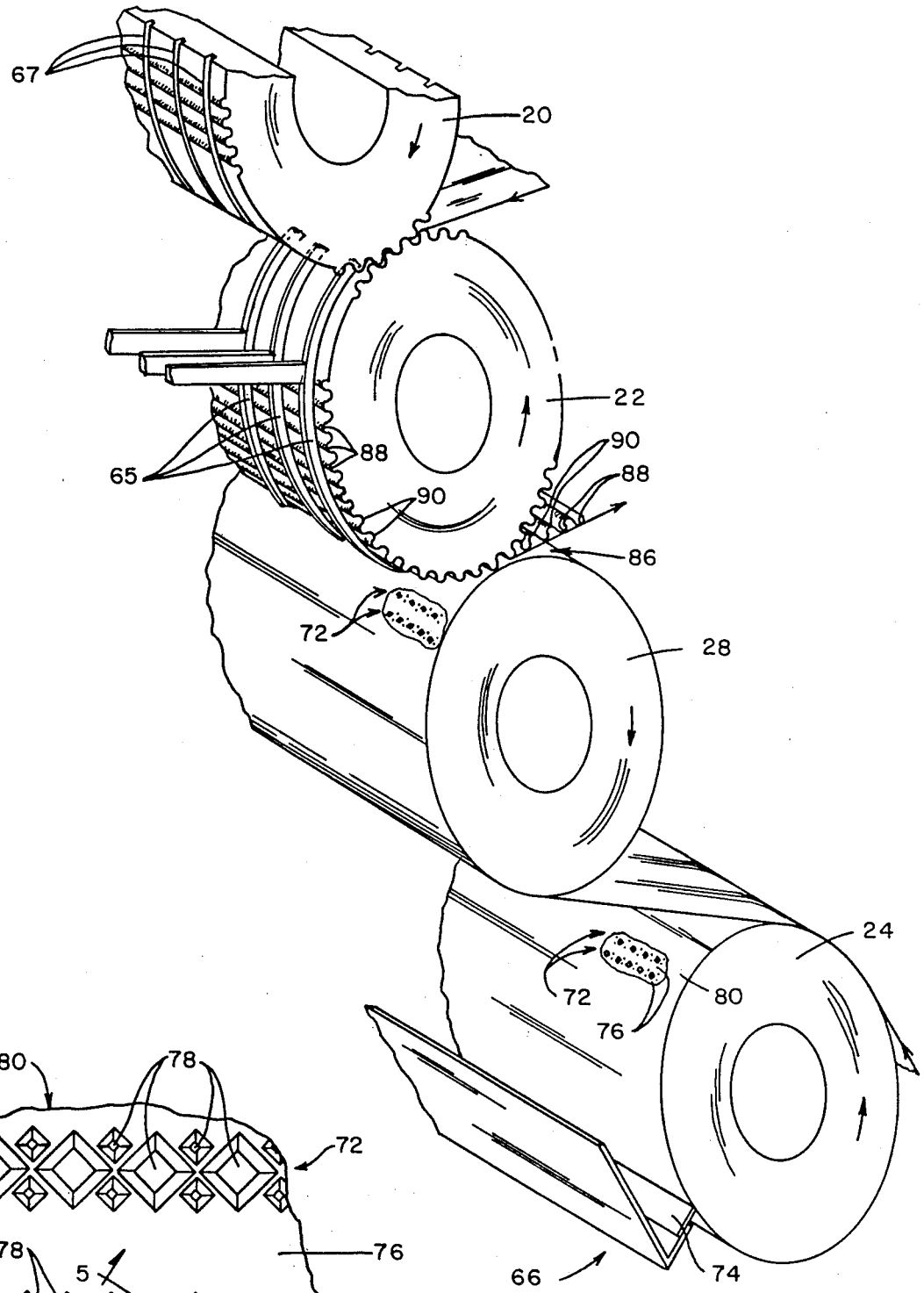
FIG. 3 is a further enlarged perspective view of the same single-facer unit

The medium 18 shown in FIG. 2 is corrugated as it passes between the corrugating rollers 20 and 22 each of which has a surface contour defined by alternate ridges and valleys that closely mate with each other and extend the length thereof. The present improvements can be used with existing state of the art corrugating machines as well as with new machines including machines that contain guide fingers, vacuum means or air pressure means to hold the corrugated medium against the lower corrugating roller 22. A plurality of spaced guide fingers 65 for this purpose are shown in FIGS. 2 and 3 and extend around one side of the second corrugating roller 22. The upper ends thereof extend into respective grooves 67 in the corrugating roller 20 where they operate to strip the corrugated medium 18 therefrom and hold it against the corrugating roller 22 until it reaches and enters the nip between the second corrugating roller 22 and the pressure roller 28. The subject improvements can also be applied with little or no machine modification to those portions of existing machines, and this is an important advantage for the present improvements because it indicates they have broad application in the corrugating field.

The applicator roller 24 is positioned adjacent to the pressure roller 28 and has a doctor blade/adhesive reservoir 66 containing adhesive 68. In this way some of the adhesive 68 is continuously being picked up by the surface 80 of the roller 24 as the roller 24 rotates. The roller 24 is shown in FIG. 2 rotating in a counterclockwise direction and the adhesive 68 that it picks up is preferably a cold-set adhesive such as a vinylacetate ethylene, polyvinyl acetate, polyvinyl alcohol or other synthetic co-polymers, compounds or resins, although other types of adhesives including particularly those that are applied cold and cure relatively rapidly are preferred. The pressure roller 28 is shown positioned between the second corrugating roller 22 and the applicator roller 24 so as to prevent debris from the corrugating process from falling onto the applicator roller 24 or into the adhesive 68. This is important because of the close tolerances under which the adhesive 68 is applied to the liner 26 by the applicator roller 24. The close tolerances are produced taking into account the speed of rotation of the applicator roller 24, and the closeness of the spacing of the rows or lines 72 (FIGS. 3 and 4) of adhesive 68 as applied to the liner 26, as will be explained more fully in what follows.

Figure 4:
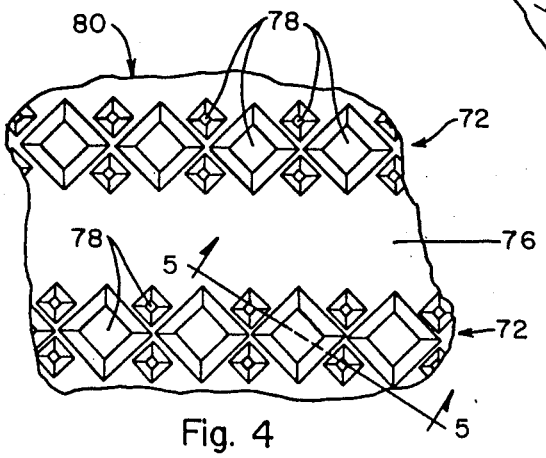
FIG. 4 is a still further enlarged fragmentary view showing a portion of the surface of an adhesive applicator roller employed in the single-facer unit of FIGS. 1A, 2 and 3.

A wiper or doctor blade 74 which may form one side of the reservoir 66 is located adjacent to the applicator roller 24. The blade 74 is preferably biased into engagment with the roller 24 and is provided to remove by a scraping action excess adhesive 68 from the surface of applicator roller 24. The scraping action of the wiper blade 74 removes excess adhesive especially from the smooth surface portions 76 of the roller 24 but without removing adhesive that has accumulated in a plurality of small surface depressions 78 formed in the rows 72 on the roller surface 80 (FIG. 4). The surface depressions 78 are etched or otherwise formed preferably in the rows 72 at spaced precise locations in the surface 80 of the applicator roller 24. The form and locations of the rows 72 of the depressions 78 are important and will be more fully explained in connection with FIGS. 3, 4, and 5. The shape of the depressions 78 should preferably also be such that they do not have straight sides parallel to the axis of the roller. This improves the adhesive metering action. The small amounts of adhesive 68 that remain in the depressions 78 after the surface 80 of the roller 24 is scraped is thereafter transferred as in a printing operation from the roller 24 onto the surface of the liner 26 during the time that the liner 26 is held in contact with the surface 80 of the roller 24. This can be accomplished in various ways including by providing means such as tension rollers 82 and 84 positioned as shown in FIG. 2. In the embodiment shown in FIG. 2, contact occurs between the liner 26 and the roller 24 over an arc of the roller 24 which is preferably between from about 60° and about 120°, although the precise amount of such engagement is not critical and depends on the speed of rotation of the rollers, the cohesive properties of the specific adhesive formula, and the related dyne factors of the adhesive, applicator roll and liner. By incorporating wrap around adjustment mechanisms using the rollers 82 and 84, a relatively wide range of adhesive contact can be achieved. The important thing is that the contact be long enough to transfer adhesive from the depressions 78 to the liner 26 in rows of adhesive dots. The liner 26, after leaving contact with the roller 24, is drawn around the pressure roller 28 until it reaches and passes through nip 86 where the surface of the liner 26 with the rows of adhesive dots on it comes in contact with the corrugation peaks 88 on one side of the now corrugated medium 18. It is important to have each row of adhesive on the liner 26 come in contact with a corresponding corrugation peak 88 on one side of the medium 18 to complete the construction of the single-face corrugated web 30. The two joined portions of the single-face web 30 can then be held engaged while the adhesive dries and sets and, in some cases, depending on the adhesive it can be heated to complete the curing of the bond between the liner 26 and the medium 18. If a single-face corrugated web is all that is required then the process is completed. If however, a double-face corrugated web is desired, then the single-face web 30 must also pass through the double-facer unit 14 (FIGS. 1B and 6) so that the second liner 50 can be bonded to the corrugation flutes 90 on the opposite surface of corrugated medium 18 from the liner 26. In this case, the single-face web 30 that has been formed can be accumulated for later feeding to the double-facer unit 14.

Referring to FIG. 3, the applicator roller 24 is shown having the surface 80 smooth over most of its area but which has a plurality of the spaced pockets or depressions 78 etched, engraved or otherwise formed therein. The depressions 78 are arranged on the surface 80 in spaced transverse parallel rows 72 which are spaced apart by the same distance as the distance between adjacent peaks of flutes 88 of adjacent corrugations of the corrugation medium 18 as aforesaid. The roller 24 is shown positioned with a portion thereof contacting the adhesive 68 in the reservoir 66 so that the roller 24 picks up some of the adhesive 68 as it rotates. The adhesive 68 fills the depressions 78 and covers the roller surface 80 as it enters the adhesive. The wiper blade 74 is positioned so as to scrape the surface 80 of the roller 24 to remove all adhesive from the surface 80 leaving adhesive only in the depressions 78. The roller 24, as it rotates, transfers or "prints" the adhesive retained in the depressions 78 in a similar dot pattern onto the liner 26 in correspondingly spaced transverse parallel rows 72 of adhesive dots as the liner 26 moves thereagainst. An alternate configuration shown in FIG. 10 would incorporate known wiper blade techniques using a pan type reservoir 92 and a partially submerged applicator roller 24 and wiper blade assembly 94. The adhesive 68 is transferred from the depressions 78 onto the liner 26 without any substantial pressure being applied as in the above case because of the characteristics of the adhesive itself including its tackiness, relative surface tension, and shear properties. One volume or dot of adhesive 68 is transferred onto the liner 26 from each of the depressions 78. The spacing of the depressions 78 and of the adhesive dots produced thereby on the liner 26, and the size and geometry of the depressions 78 are selected to produce nearly continuous rows 72 of precise adhesive volumes or dots on the liner 26 at the locations where the liner thereafter comes in contact with the flutes 88. After the adhesive dots are applied, the liner 26 moves with the pressure roller 28 until it reaches and passes through the nip 86. The liner 26 enters the nip 86 formed by and between the corrugating roller 22 and the pressure roller 28 and in so doing the rows of the adhesive dots come into contact with the respective corrugation peaks 88 and adhesively bond the liner thereto.

Synchronizing means including electronically controllable variable speed drive motors (not shown) are used to control the rotational speeds of the first and second corrugating rollers 20 and 22, the pressure roller 28 and the applicator roller 24. Controlling the rotational speeds of the rollers in the single-facer unit advances the liner 26 through the single-facer unit 12 at the same speed as the advancing speed of the corrugated medium 18 and brings the rows 72 of adhesive dots into precise registration with and in contact with the corrugation peaks or flutes 88 as the liner 26 and the medium 18 come together and enter the nip 86 together.

The improved single-face web 30 so constructed has better crushing strength, improved appearance including a much smoother liner surface than similar webs made using conventional not-set adhesives and which are operated so that adhesive is applied over greater areas of the corrugating peaks and flanks than in the present construction. This is because when using conventional systems the adhesive is actually smeared over the flute peaks and the conventional hot-set adhesives shrink during curing which produces an undesirable washboard effect to the liner. The smoother surface produced by the present system enables the liner side of the web 30 to be very smooth even to the extent that matter can be printed thereon much more accurately even when the printing is done on the completed single or double-face web. This is due largely to the controlled volume of adhesive used, the precise connection between the members, and to the fact that no adhesive is being wiped onto the corrugation flanks. The use of rows of precise depressions 78 in an otherwise smooth surfaced roller also substantially reduces the volume of adhesive applied, and this in turn reduces the cost of producing corrugated products. The depressions 78 may be of many different shapes and sizes as required by the characteristics of the adhesive 68 being transferred, and the spacing of the depressions 78 in the rows should be such as to cause almost continuous lines of bond to take place between the members. The depressions 78 shown in FIGS. 4 and 5 have truncated pyramidal shapes with pointed forward and trailing ends, which shape may offer advantages in some cases although other shapes and depths of the depressions can also be used including round shaped depressions, oval depressions, triangular shapes, zig zag channels and so forth. Although in general the dimensional configuration and lateral spacing of these depressions are not critical, an optimum pattern for these would be determined for each given range of adhesive formulations, corrugating materials and flute dimensions.

In the double-facer unit 14 as shown in FIG. 6, the adhesive applicator system 48 is shown including adhesive applicator roller 100 which is positioned such that a portion thereof contacts adhesive in container or trough 102 one wall of which forms a scraper or doctor blade 104 such that some of the adhesive 106 is continuously being picked up by the surface 108 of the applicator roller 100 as the roller 100 rotates. The roller 100 is shown rotatable in a clockwise direction, and the adhesive 106 which is in depressions 110 (FIG. 7) is applied to the flute tips 90 of the corrugated medium 18 on the surface of the single-face web 30 opposite from the liner 26. As in the case of the adhesive 68, the adhesive 106 is preferably a cold-set adhesive such as one of those mentioned above. The wiper or doctor blade contacts the smooth surface areas of the roller surface 108 between the depressions 110 and scrapes off the excess adhesive therefrom. In this way, adhesive is removed from the roller surface 108 without removing the adhesive that has accumulated in precise depressions 110 which are etched, engraved or otherwise formed at spaced locations in the surface 108. However, in the case of the roller 100, which applies adhesive to the corrugation peaks 90 of the single-facer web 30 rather than to a liner, the entire surface 108 of the roller 100 is etched, engraved or otherwise formed with the depressions 110 and not merely rows of depressions as in the case of the applicator roller 24 in the single-facer unit 12.

The completed single-face corrugated web 30 which has accumulated in folds on the bridge 16 is drawn therefrom (FIGS. 1A and 1B) and moves along a support structure and from there enters the double-facer unit 14 as shown in FIG. 1B, for example. In so doing, it passes under the suction device 46 which applies holding power or drag thereto so that the single-face web 30 is placed under some tension as it moves into the double-facer unit 14 as shown and under idler roller 112 and over and around the upper portion of the adhesive applicator roller 100 and under idler roller 114, if used. In some configurations it may be desirable to have idler rollers 112 and 114 and not in others depending on how the web 30 approaches and enters the roller 100. After the single-face web 30 has passed under roller 114 it passes over another roller 116, if used, and combines with liner 50 to form double-face web 54 which then enters between the belt 56 and the support plate 58 and if necessary passes through an adhesive curing unit which is not detailed in FIGS. 1B and 6. Rollers 118, 120, 122, 124, 126, 128 and 130 which support the belt 56 and the plate 58 are intended to be shown as conceptual, and are parts of the entire curing unit, which may be of conventional construction. The locations of rollers, belts, slip plates, as well as the associated frictions and pressures involved must be such as to apply minimal stress on the corrugated structure, yet it must be sufficiently firm to achieve a satisfactory adhesive bond. The curing unit may also be constructed to include top and bottom synchronized pull belts. A single pull belt and a slip plate, a vacuum pull belt, a top pull belt and heating chamber (if heat set adhesives are used) or any other satisfactory arrangement or combination thereof can be used without departing from the present invention.

The principal tension controls may be of various known designs, and are normally located at positions such as those depicted in FIG. 1B. These function to restrict the forward movement of the single-face web 30 (and 60) as it is pulled through the adhesive unit 48 (and 62) and into the output curing section. The important thing is to bring the exposed flute peaks 90 into contact under some tension with the surface 108 of the roller 100 and for a long enougn time for the adhesive to be transferred thereto. The tension produced by the vacuum suction means 46 is adjusted to maintain sufficient contact between the flute peaks 90 and the surface 108 to transfer adhesive from the depressions 110 onto the peaks 90 but the tension should not be sufficient to crush or damage the flute peaks. The second liner 50 which is to be attached to the flute peaks 90 is drawn from the supply roller 52 (FIG. 1B) as stated and is guided by guide rollers 132 and 116 into contact with the exposed peaks 90 of the web 30, which peaks now contain adhesive. The second liner 50 contacts the adhesive on the peaks 90 as the liner 50 moves over the guide roller 116 and at this time the liner 50 bonds to the single-face web 30 to form the double-face corrugated web 54. The members are thereafter maintained engaged with each other by the means described for a long enough time for the adhesive to set. The application of heat is usually not necessary for this but some heat may be applied if desired.

The means to hold the members together is shown conceptually in FIG. 6 between the belt 56 and plate 58 and apply enough pressure to retain the corrugated web 54 or the multi-ply board 134 therebetween and hold the parts together as the adhesive sets up and cures.

This way of curing, preferably without heat, reduces or prevents warpage of the finished product.

One or more additional single-face corrugated webs such as single-face web 60 (FIG. 6), similar to the single-face web 30, can be formed, accumulated as on the second bridge member (not shown) and can be drawn therefrom and made to pass through the second double-facer adhesive applicator unit 62 for attachment to the smooth surfaced liner side of double-face web 54 already described to form a multi-ply corrugated structure. The applicator unit 62 applies adhesive to the exposed corrugation peaks (not shown) of the web 60 in a manner similar to that described above for web 30, and the corrugation peaks of the web 60 are brought into engagement with and adhesively bonded to one side of the liner 26 on one side of the double-face corrugated web 54. This takes place as the double-face web 54 and the single-face web 60 enter between the belt 56 and the plate 58. Some adjustment of the position of the rollers 124–130 that support the belt 56 may be necessary to accommodate the greater thickness of the multi-ply corrugated structure. Additional similar single-face corrugated webs can be attached to further increase the thickness of the resulting structure in a similar manner.

Referring to FIG. 7, the outer surface 108 of the applicator roller 100 is shown having a plurality of the spaced pockets or depressions 110 etched or otherwise formed therein. The depressions 110 are distributed over the roller surface 108 in a uniform arrangement and density, and the depressions 110 are spaced so that the roller surface 108 between the depressions is continuous. However, with the applicator roller 100, it is not necessary or even desirable to have the depressions 110 arranged in rows since it is only necessary that the adhesive contained therein after scraping be applied along the length of the corrugation peaks and not in rows on a liner. The depressions 110 should be spaced close enough together so that the adhesive applied will be more or less continuous along each of the corrugation peaks. However, sequencing the precise locations where the corrugation peaks 90 engage and bond to the liner 50 for the attachment of the second liner thereto as well as the attachment of additional single-face corrugated webs is not critical as it is in the case when attaching a first liner 26 to make the single-face web 30.

Figure 8:
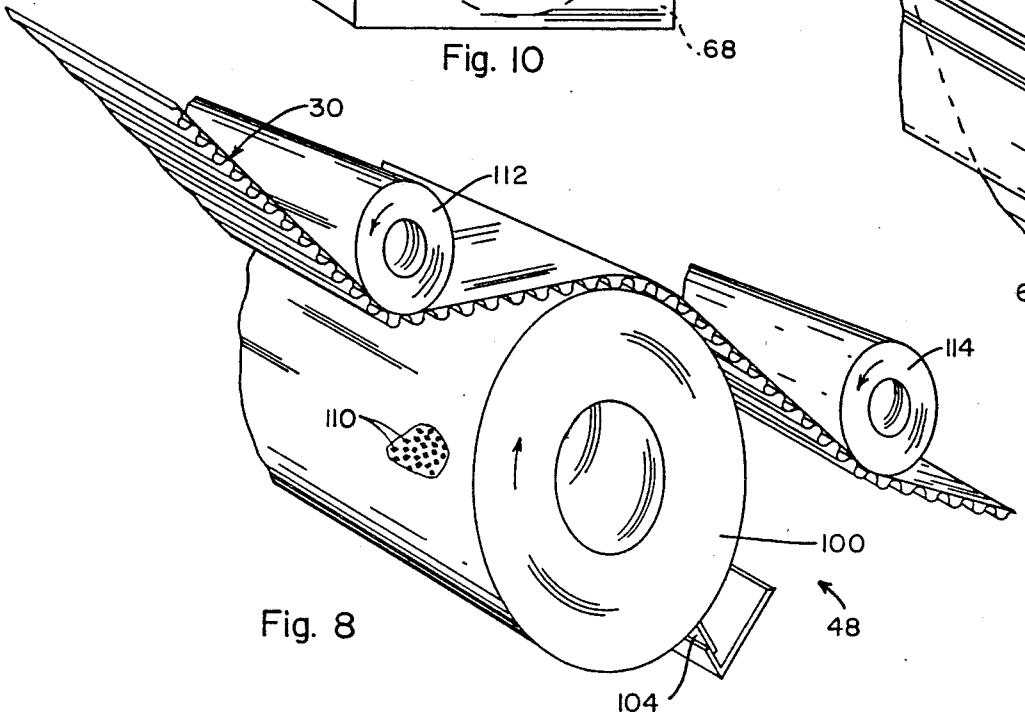
FIG. 8 is a further enlarged perspective view of the adhesive applicator roller and optional associated idler rollers employed in the double-facer unit shown in FIGS. 1B and 6.

A preferred embodiment of the double-facer adhesive applicator unit 48 is shown in greater detail in FIG. 8. In this figure, idler roller 112 and an optional second idler roller 114 are shown located such that the flutes of the single-face web 30 are held engaged with the applicator roller 100 over an arc thereof in order to give the adhesive sufficient contact time with the flute peaks 90 as the roller turns. The tension on the single-face web 30 combined with the positions of the rollers 112, 114 and 100 controls the time during which the flute peaks engage the roller surface 108, and the force applied during this time should not be so great as to deform or crush the corrugations. It is preferred, however, that the surfaces of the rollers 112, 114 and 100, when all are used, move at the same speed as the single-face web 30 so that there will be no slippage between the single-face web 30 and the applicator roller 100. The positions of the rollers 112, 114 and 100 is not dictated by the thickness or "grade" of the members that pass therebetween and therefore operating adjustments to compensate for changing materials is not normally required. The angle of approach of the web 30 to the roller 100 and the exit therefrom determines how many idlers will be necessary. In some cases it is expected that it may be possible that no idlers will be required. The maximum strength characteristics for the finisned product, however, are achieved when the corrugations retain their initial shapes as they are formed when the medium 18 passes between the corrugating rollers 20 and 22.

The above described way of transferring adhesive from the roller 100 to the corrugation peaks 90 provides a better bond between the peaks 90 and the liner 50, with less adhesive, and results in the production of a double-face corrugated web 54 having smoother exposed liner surfaces than is true of corrugated structures made using known corrugating machines. The smoother liner surfaces also makes for better appearing structures and allows for more detailed graphics to be printed thereon and enhances the usefulness and marketability of corrugated products.

The above described method of transferring adhesive also precisely regulates the amount of adhesive used, thereby making cold-set adhesives practical, which in turn eliminates the expense of installing and maintaining heated machine components, as well as eliminates the operator-required adjustments to balance the heat, live steam and adhesive application rate for each different set of liners and mediums being used.

Figure 9:
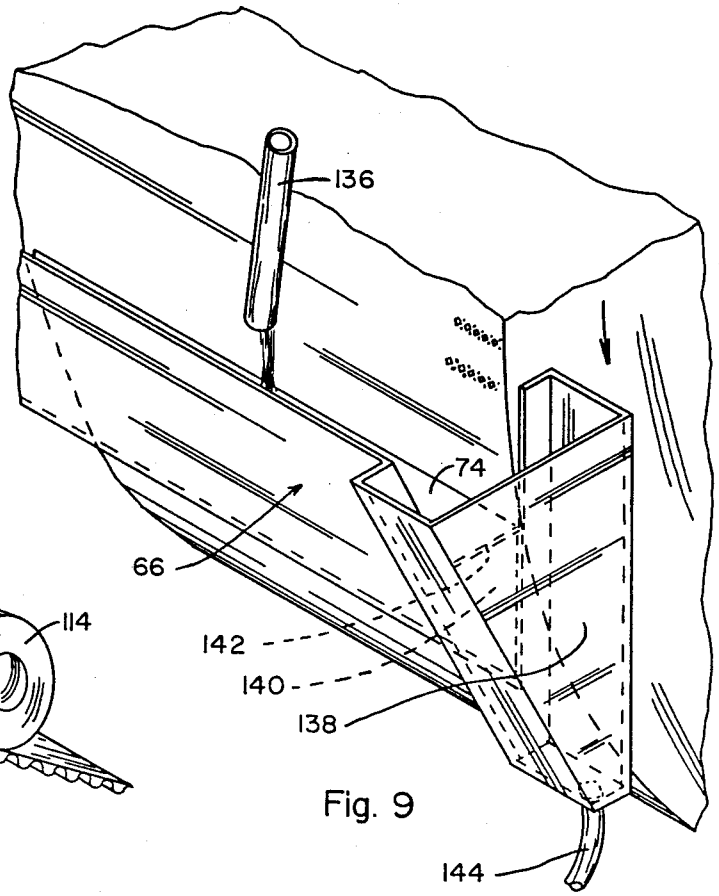
FIG. 9 is a fragmentary perspective view showing a portion of a preferred embodiment of an adhesive container for use with the subject device; and, FIG. 10 is a fragmentary perspective view showing an alternate embodiment of an adhesive container and wiper blade assembly used for applying adhesive to the surface of an adhesive applicator roller.

FIG. 9, is a detailed drawing of the specially constructed adhesive container assembly or reservoir 66 including the wiper blade 74 which is incorporated as part thereof. The container assembly 66 is located adjacent to one side as distinguished from the bottom of the applicator roller 24 (or 100) and the adhesive 68 contained therein is fed to the container through inlet conduit 136 during a corrugating operation and maintained at a predetermined adhesive depth therein. The assembly 66 is suitable for use in a single-facer unit such as the unit 12 shown in FIG. 1A or in a double-facer unit such as the unit 14 shown in FIG. 1B. When the container assembly 66 is used it is located such that a portion of the applicator roller 24 (or 100) is adjacent to the open side of the container where it comes into contact with the adhesive, and the wiper blade 74 is shown as a part of the container assembly 66 and is positioned such that the portion of the surface 80 (or 108) of the applicator roller 24 (or 100) comes in contact therewith. As this portion of the roller 24 (or 100) exits the container the excess adhesive is scraped off as aforesaid. The container assembly 66 extends along the length of the roller 24 (or 100) and liquid adhesive is fed to the assembly 66 during operation through the conduit 136 shown located thereabove. The container assembly 66 also has end wall portions 138 which act as catch or overflow basins and are separated from the main portion of the assembly 66 by end walls 140, the upper edges 142 of which control the maximum depth of adhesive therein. When the adhesive exceeds the upper edges 142 of the walls 140 it overflows and enters the catch basins 138 which have tubes 144 that feed back to the inlet adhesive supply for recirculation. It is expected that the rate of feed of adhesive to the container 66 will be such that the chance for overflow and feedback will only occur due to some malfunction of the system.

Figure 10:
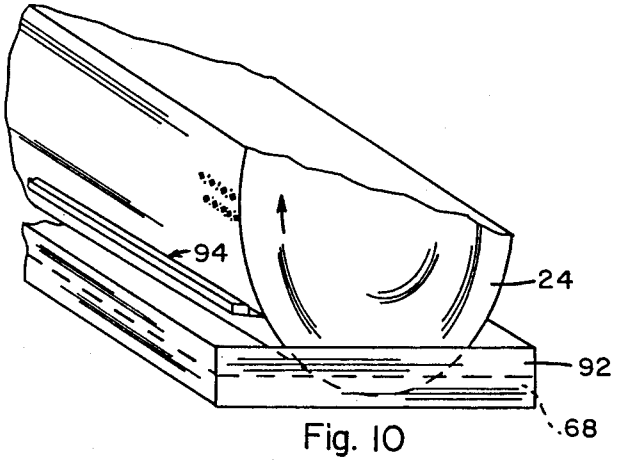

FIG. 10 as explained above shows an alternative adhesive metering system whereby the adhesive roll 24 (or 100) is partially submerged in an adhesive bath 68. The roll is shown rotating in a clockwise direction, and the doctor blade assembly 94 contacts the roll surface and removes adhesive except for that which is contained in the depressions. All adhesive so removed drains back into the container 92 where it can be reused.

Thus there has been shown and described novel, non-obvious improvements to corrugating machines used for producing single-face, double-face and multiply corrugated panels or boards, including improvements to the single-facer corrugating units and to the double-facer corrugating units which fulfill all of the objects and advantages sought therefor. It will be apparent to those skilled in the art, however, after a review of this description that many changes, modifications, variations, and other uses and applications for the subject constructions, in addition to those which have been disclosed, are possible and contemplated, and all such changes, modifications, variations, and other uses and applications which do not depart from the spirit and scope of the invention are deemed to be covered by the invention which is limited only by the claims which follow.

What is claimed is:

1. An apparatus for making a double-face corrugated web from a single-face web formed by a corrugated member having spaced corrugation ridges on both opposite surfaces, the corrugation ridges on one surface being attached to a first liner member, and a second liner member to be attached to the corrugation ridges on the surface of the corrugated member opposite from the first liner member, the apparatus comprising an adhesive applicator roller having a cylindrical outer surface defined by a smooth surface with a plurality of spaced depressions formed therein and distributed in a uniform arrangement and density over the outer surface thereof, container means to directly apply an adhesive substance in liquid form to a portion of the surface of the applicator roller to fill the depressions therein and including means to maintain a predetermined amount of adhesive that can be contained in the container means and scraping means associated with the container means in position to positively engage with the smooth cylindrical portion of the applicator roller to bear against the surface thereof substantially uniformly along the length thereof and positioned against the direction of rotation thereof to uniformly scrape excess adhesive therefrom leaving a quantity of the adhesive in the depressions therein, means spaced apart from the applicator roller a distance greater than the thickness of a single-faced web to maintain the corrugation ridges on one side of the single-face web engaged with the surface of the applicator roller over a predetermined arcuate portion of the surface thereof, means for rotating the applicator roller whereby adhesive from the spaced roller depressions has time to be transferred to the corrugation ridges by such engagement, and other means for bringing the second liner member into contact with the corrugation ridges under pressure to produce adhesive connections therebetween.

2. The apparatus of claim 1 wherein the adhesive in the container is a cold-set adhesive.

3. The apparatus of claim 1 including means located with a portion of the applicator roller positioned adjacent and apart therefrom to form a non-linear path for the single-face web to move on and to control the predetermined arcuate portion of the applicator roller against which the single-face web is engaged.

4. The apparatus of claim 3 wherein the means located adjacent and apart from a portion of the applicator roller includes an idler roller spaced from one side thereof.

5. The apparatus of claim 3 wherein the means located adjacent and apart from a portion of the applicator roller includes a pair of spaced apart idler rollers.

6. The apparatus of claim 1 including means to support the double-face web after it is formed to maintain the web under predetermined pressure for a time period long enough for the adhesive to set.

7. The apparatus of claim 6 including means to maintain a desired curing environment adjacent to the web support means.

8. The apparatus of claim 1 wherein the spaced depressions are etched into the cylindrical outer surface of the applicator roller.

9. The apparatus of claim 12 wherein the spaced depressions are engraved into the cylindrical outer surface of the applicator roller.

10. An apparatus for making a double-face corrugated board comprising a single-facer unit and a double-facer unit, said single facer unit comprising first and second corrugating rollers each having a surface contour defined by alternating ridges and furrows that extend along the length thereof, means mounting said first and second corrugating rollers for rotation such that the ridges and furrows of the rollers mesh to corrugate a medium moving therebetween to form a medium having spaced corrugation ridges and valleys, a pressure roller located adjacent to said second corrugating roller at a location spaced from the first corrugating roller to form a nip therebetween, means to maintain and support the corrugated medium in contact with said second corrugating roller approximately until said medium reaches the nip, an adhesive applicator roller having a cylindrical surface with spaced rows of discrete depressions corresponding to the spacing of the corrugation ridges on one side of the corrugated medium, the applicator roller and said second corrugating roller located adjacent to spaced locations on the pressure roller such that the pressure roller is substantially positioned therebetween, said applicator roller being spaced from said pressure roller, an adhesive container closed at both ends and sides including by the applicator roller extending alongside and adjacent to one side of the applicator roller in position to directly expose a portion of the surface of the applicator roller to adhesive in the container whereby adhesive is applied to the roller surface including to the discrete depressions therein, means positively engaged with the surface of the applicator roller to bear against the surface thereof substantially uniformly along the length thereof and positioned against the direction of rotation thereof to uniformly scrape adhesive from the surface thereof but not from the depressions, means in the container to control the depth of the adhesive that can be contained therein, a supply of a first liner material and means spaced apart from the applicator roller to move the first liner material from the supply to and into contact against a predetermined arcuate portion of the surface of the applicator roller so there is time for the adhesive contained in the rows of discrete depressions to make contact with and be transferred as rows of adhesive dots to the first liner by such contact, means to advance said first liner from engagement with the applicator roller around a portion of the pressure roller and into and through the nip where the rows of adhesive dots transferred to the first liner come in contact with respective corrugation ridges on one side of the corrugated medium to bond the first liner thereto to form a single-face corrugated web having the first liner on one side and exposed corrugation ridges on the opposite side thereof, means to support the single-face corrugated web as it exits from the nip and while it advances to the double-facer applicator roller and means to guide the corrugation ridges on the opposite side of the single-face web into engagement with a predetermined arcuate portion of the surface of the double-facer applicator roller, said double-facer applicator roller having a cylindrical surface defined by a plurality of discrete depressions formed therein and distributed in a uniform arrangement and density over the surface thereof, means for rotating said double-facer applicator roller, container means for a supply of adhesive positioned adjacent to one side of the double-facer applicator roller in position directly exposing a portion of the surface of the applicator roller including the discrete depressions therein to the adhesive contained therein, a scraper device positively engaged in a direction opposing the direction of rotation of the cylindrical surface of the applicator roller to bear against said surface substantially uniformly along the length thereof for uniformly scraping away excess adhesive except for the adhesive that accumulates in the discrete depressions, means spaced apart from the double-facer applicator roller a distance greater than the thickness of a single-faced web to maintain the corrugations on said single-face web engaged with the double-facer applicator roller surface over a predetermined arcuate portion thereof whereby residual adhesive in the discrete depressions has time to be transferred by such engagement as adhesive dots onto the corrugation ridges, side and end wall means on the container means, the end wall means including means to control the maximum depth of adhesive that can be contained therein and therefore the area of the applicator roller that is in contact with adhesive at any one time, a supply of a second liner material including means to move the second liner material therefrom and against the corrugation ridges and the adhesive dots thereon whereby the adhesive contained in the adhesive dots attaches the second liner to the single-face web, and means to maintain the second liner engaged with the single-face web until the adhesive sets.

11. The apparatus of claim 10 wherein said means to scrape include a scraper blade as part of said container means and means to maintain the scraper blade engaged with the surface of the applicator roller positioned against the direction of rotation thereof.

12. The apparatus of claim 10 wherein the depressions in the surface of the single-facer applicator roller surface are etched therein.

13. The apparatus of claim 10 including at least one idler roller positioned adjacent to but spaced apart from one side of the double-facer applicator roller in position to engage the single-face web and maintain the single-face web engaged with the double-facer applicator roller over a predetermined arcuate portion of the surface thereof.

14. The apparatus of claim 10 including means to register said rows of adhesive dots transferred to said first liner with the corrugation peaks on one side of the corrugated medium.

15. The apparatus of claim 10 wherein the adhesive in the container is a cold-set adhesive.

* * * * *

UNITED STATES PATENT OFFICE

CERTIFICATE OF CORRECTION

Patent No. 4,853,072 Dated August 1, 1989

Inventor(s) Frederick H. Thompson

It is certified that error appears in the above-identified patent and that said Letters Patent is hereby corrected as shown below:

Column 3, Line 41, "nign" should be --high--.

Column 6, line 22, add a period (.) after"utilized" and before "The".

Column 8, line 62, after "unit" add a semi-colan (;).

Column 13, line 4, "not-set" should be --hot-set--.

Column 14, line 44, "enougn" should be --enough--.

Column 19, line 3, after "double-facer" insert --unit, the double-facer unit including a double-facer--.

Signed and Sealed this

Tenth Day of July, 1990

*Attest:*

HARRY F. MANBECK, JR.

*Attesting Officer*

*Commissioner of Patents and Trademarks*